United States Patent [19]

De Keyzer et al.

[11] Patent Number: 4,686,174

[45] Date of Patent: Aug. 11, 1987

[54] METHOD AND MATERIAL FOR THE PRODUCTION OF CONTINUOUS TONE SILVER IMAGES BY THE SILVER COMPLEX DIFFUSION TRANSFER REVERSAL PROCESS

[75] Inventors: René M. De Keyzer, Bornem; Jos A. Vaes, Betekom; Jules R. Berendsen, Deurne, all of Belgium

[73] Assignee: Agfa-Gevaert N.V., Mortsel, Belgium

[21] Appl. No.: 816,839

[22] Filed: Jan. 7, 1986

[30] Foreign Application Priority Data

Jan. 15, 1985 [EP] European Pat. Off. ..... 85100348

[51] Int. Cl.[4] ..... G03C 5/54; G03C 1/48; G03C 1/76

[52] U.S. Cl. ..... 430/502; 430/227; 430/230; 430/248

[58] Field of Search ..... 430/230, 227, 234, 244, 430/248, 249, 502

[56] References Cited

U.S. PATENT DOCUMENTS

| | | | |
|---|---|---|---|
| 3,985,561 | 10/1976 | De Haes et al. | 430/230 |
| 4,165,986 | 8/1979 | Walworth . | |
| 4,401,753 | 8/1983 | Vaes et al. | 430/230 |

*Primary Examiner*—John L. Goodrow
*Attorney, Agent, or Firm*—William J. Daniel

[57] ABSTRACT

A photographic material for the production of continuous tone silver images by the diffusion transfer reversal process using at least two independently prepared silver halide emulsions of different photo-sensitivity and having a silver halide composition as defined in the description, either in admixture in a single supported emulsion layer or coated on the same support as separate superposed emulsion layers.

12 Claims, 5 Drawing Figures

METHOD AND MATERIAL FOR THE PRODUCTION OF CONTINUOUS TONE SILVER IMAGES BY THE SILVER COMPLEX DIFFUSION TRANSFER REVERSAL PROCESS

The present invention relates to a method and material for the production of continuous tone silver images by the silver complex diffusion transfer process.

The principles of the silver complex diffusion transfer reversal process, hereinafter called DTR-process have been described e.g. in the U.S. Pat. No. 2,352,014 of André Rott issued June 20, 1944.

In the DTR-process, silver complexes are image-wise transferred by diffusion from a silver halide emulsion layer to an image-receiving layer, where they are converted, preferably in the presence of development nuclei, into a silver image. For this purpose, an image-wise exposed silver halide emulsion layer is developed by means of a developing substance in the presence of a so-called silver halide solvent. In the exposed parts of the silver halide emulsion layer the silver halide is developed to silver so that it cannot dissolve anymore and consequently cannot diffuse. In the non-exposed parts of the silver halide emulsion layer the silver halide is converted into soluble silver complexes by means of the silver halide solvent acting as a silver complexing agent and transferred by diffusion to an adjacent image-receiving layer or an image-receiving layer brought into contact with the emulsion layer to form, usually in the presence of development nuclei, a silver, or silver-containing image in the receiving layer. More details on the DTR-process are presented in "Photographic Silver Halide Diffusion Processes" by A. Rott and E. Weyde, Focal Press, London, New York (1972).

From the prior art (e.g. GB-P No. 1,269,260) is known that silver halide compositions can be extended in exposure latitude by incorporating emulsions of various grain size in a photographic element, either in admixture or in separate layers.

In DTR-processing the preferably applied silver halide mainly contains silver chloride that is more rapidly complexing than the other silver halides such as silver bromide and silver iodide. The problem is, however, that silver chloride provides in DTR-processing images with high contrast and therefor as such is less suitable to ensure a correct tone rendering of continuous tone images.

In the U.S. Pat. No. 3,985,561 of Louis Maria De Haes et al., issued Oct. 12, 1976, a light-sensitive silver halide material is described wherein the silver halide is predominantly chloride and yet this material is capable of forming a continuous tone image on or in an image-receiving material by the diffusion transfer reversal process.

According to said last-mentioned U.S. patent a continuous tone image is produced by diffusion transfer reversal processing in an image-receiving layer through the use of a photographic material comprising a light-sensitive layer that contains a mixture of silver chloride and silver iodide and/or silver bromide dispersed in a hydrophilic colloid binder, e.g. gelatin, wherein the silver chloride is present in an amount of at least 90 mole % based on the total mole of silver halide and wherein the weight ratio of hydrophilic colloid to silver halide, expressed as silver nitrate, is between about 3:1 and about 10:1 by weight which is higher than usual.

Generally the mole % of silver iodide and/or bromide based on the total mole of halide is comprised between about 0.1 and about 10 mole %, preferably between 0.5 and 5 mole %.

With such photographic material a successful reproduction of continuous tone images can be obtained, probably as a result of the presence of the indicated amounts of silver iodide and/or silver bromide and of the defined high weight ratio of hydrophilic colloid to silver halide, wherein the hydrophilic colloid slows down the diffusion of the silver complexes to the image-receiving material and promotes continuous-tone formation. The high content of hydrophilic colloid results in a gradation that is strongly dependent on the duration of the diffusion-transfer, so that in different types of processing apparatus quite different results in image gradation may be obtained.

From the German patent specification No. 900,298 referring to German patent specification No. 887,733, it is known to carry out the DTR-process with a negative working silver halide emulsion layer wherein high-sensitive silver bromide emulsion is used in admixture with a less sensitive silver chloride emulsion. No specific information has been given, however, for obtaining a low contrast or continuous tone result in the image-receiving layer.

It is one of the objects of the present invention to provide a method for the production of continuous tone silver images by the diffusion transfer reversal process which avoids the need for a relatively high gelatin to silver halide weight ratio in the silver halide emulsion layer of the photographic material.

It is a further object of the present invention to provide a photographic material for continuous tone reproduction by DTR-processing by means of which the gradation of the DTR-image can be controlled by the processing temperature and substantially independently of the diffusion transfer time.

Other objects and advantages of the present invention will become clear from the following description.

According to the present invention a method for the production of continuous tone silver images by the diffusion transfer reversal process is provided, wherein a photographic material is image-wise exposed to continuous tone information and subjected to diffusion-transfer-reversal processing under alkaline aqueous conditions in the presence of at least one developing agent and a silver ion complexing agent, or so-called silver halide solvent, hereby transferring complexed silver ions into a receiving layer that is different from the emulsion layer and contains development nuclei catalyzing the reduction of transferred complexed silver ions, characterized in that, (1) the photographic material to be exposed contains two independently prepared hydrophilic colloid-silver halide emulsions of different halide composition and different photo-sensitivity in operative contact on the same support, i.e., either in admixture in a supported single emulsion layer or coated as separate superposed emulsion layers on the same support;

(2) one of said silver halide emulsions, called emulsion P, is a silver halide emulsion containing at least 70 mole % of silver chloride and from 0 to 5 mole % of silver iodide, preferably from 0.02 to 1 mole % of AgI, the remainder being silver bromide, and the other silver halide emulsion, called emulsion Q, is a silver bromide emulsion free from AgCl or is a silver bromochloride emulsion provided the silver chloride content does not exceed that of emulsion P by more than 2 mole %, emulsion Q containing from 0 to 10 mole % of AgI, preferably from 0.02 to 8 mole % of AgI;

(3) the silver halide emulsion Q has a higher sensitivity to 400–700 nm light than the silver halide emulsion P in such a degree that under the same wedge exposure conditions and development conditions (as defined hereinafter) the log exposure values (log E) of an emulsion layer P containing only silver halide emulsion P on a transparent support and of an emulsion layer Q containing only silver halide emulsion Q on such support at the same silver halide coverage of $3.5\times10^{-2}$ moles of silver halide per $m^2$ and having a ratio by weight of gelatin binder to silver halide expressed as equivalent grams of silver nitrate of 0.5, when measured at density 0.3, differ from each other by a value of at least 0.30 and at most 1.50, and (4) the molar proportion in said photographic material of silver halide grains of emulsion P to silver halide grains of emulsion Q is such that the maximum gradient or so-called gamma ($\gamma$), of the sensitometric curve (obtained by plotting optical density versus log exposure) of a wedge image obtained by said diffusion-transfer-reversal process with said photographic material in an image-receiving layer applied on an opaque support having a diffuse reflection density of 0.08 is not higher than 1.50, and preferably in the range of 1.50 to 0.9 corresponding with a range of exposure latitudes (L) of 1.0 to 1.6, or (5) the molar proportion in said photographic material of silver halide grains of emulsion P to silver halide grains of emulsion Q is such that the maximum gradient, or gamma ($\gamma$), of the sensitometric curve (optical density versus log exposure) of a wedge image obtained by said diffusion-transfer-reversal process with said photographic material in an image-receiving layer applied on a transparent support having a diffuse transmission density of 0.08 is not higher than 3.00, and preferably in the range of 3.00 to 1.70 corresponding with a range of exposure latitudes (L) of 1.00 to 1.40.

The "diffuse reflection density" is measured according to the requirements of American Standard PH 2.17-1958.

The "diffuse transmission density" is measured to the requirements of American Standard PH 2.19-1959.

The exposure latitude L is the difference in relative log exposure corresponding with the straight line portion of the sensitometric curve of the DTR-images.

The difference of log exposure values by a value of at least 0.3 to 1.5 has been found to give the desired gamma on mixing the emulsions P and Q constituted as defined in (4) and (5) above, since below the value 0.3 the gradation lowering becomes two small and above the value 1.5 the final sensitometric curve exhibits a break, i.e. the toe and shoulder of the sensitometric curve show substantially different gamma values which result in a disproportionation of image tone in the highlights with respect to the shadow portions and vice versa.

The present invention also provides a photographic material for the production of continuous tone silver images by the diffusion transfer reversal process comprising in admixture in a single supported emulsion layer or coated on the same support as separate superposed emulsion layers said emulsions P and Q referred hereinbefore in the given proportions.

The development conditions applied in the above point (3) are:

| developer composition | |
|---|---|
| demineralized water | 800 ml |
| p-methylamino-phenol | 1.5 g |
| sodium sulphite | 50 g |
| hydroquinone | 6 g |
| sodium carbonate | 32 g |
| potassium bromide | 2 g |
| ethylene diamine tetra-acetic acid sodium salt | 1.5 g |
| demineralized water up to | 1000 ml |
| development temperature | 20° C. |
| development duration | 3 min. |

In a preferred embodiment said difference in photosensitivity to 400–700 nm light of said emulsion layers P and Q is obtained by using in emulsion layer P an emulsion P containing silver halide grains having a mean grain size in the range of 0.05 to 0.50 μm and by using in emulsion layer Q an emulsion Q containing silver halide grains having a mean grain size in the range of 0.1 to 1.00 μm, the chemical ripening of said both emulsions not necessarily being carried out under the same conditions.

The silver halide coverage of emulsion P with respect to emulsion Q is e.g. in the molar range or 88/12 to 96/4. A smaller ratio of silver halide coverage of said emulsions may result in a break in the sensitometric curve.

In the accompanying drawings:

FIG. 1 represents the sensitometric curves of positive images obtained in DTR-processing on the same image-receiving material with the following photographic materials:

(i) a photographic material P containing only a silver halide emulsion P, (ii) a photographic material Q containing only a silver halide emulsion Q, and (iii) a photographic material I according to the present invention containing emulsion P in admixture with emulsion Q, i.e. (P+Q).

Figure 1:
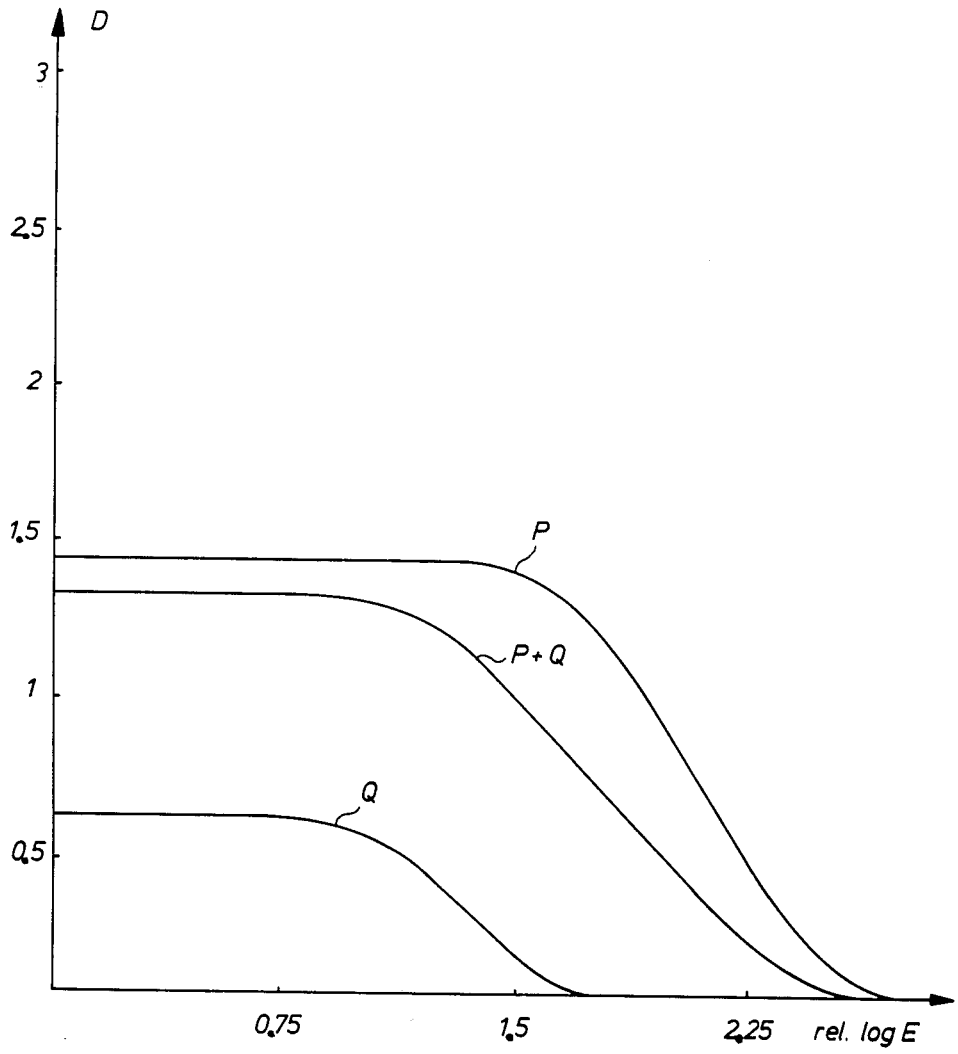

The photographic material according to the present invention may be developed by at least one developing agent applied from a developing liquid or applied in situ from the material itself using in the latter case an alkaline aqueous liquid to activate the development.

The developing agent(s) may be present in the silver halide emulsion layer(s) but are preferably present in a hydrophilic colloid layer in waterpermeable relationship therewith, e.g. in an anti-halation layer adjacent to a silver halide emulsion layer of the present photographic material.

In a preferred embodiment in the photographic material of the present invention a mixture of developing agents including a o-dihydroxybenzene and a 3-pyrazolidinone developing agent is used. These developing agents are used preferably in a respective molar ratio of 10/1 to 10/3. The o-dihydroxybenzene is present preferably in an amount of 0.5 to 1 g per sq.m.

When using in said photographic material p-dihydroxybenzene developing agent, e.g., hydroquinone, the latter is present preferably in a molar ratio not higher than 3% with respect to the o-dihydroxybenzene.

A preferred ortho-dihydroxybenzene for use in a photographic material according to the invention is catechol. Other catechol developing agents useful in the present invention are described, e.g., in the U.S. Pat. No. 3,146,104 by Edward C. Yackel and Thomas I. Abbott, issued Aug. 25, 1964.

3-Pyrazolidinone developing compounds that are useful as auxiliary developing agents in the emulsion layer(s) of the present photographic material are within the scope of the following general formula;

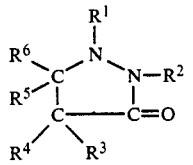

wherein:

$R^1$ represents an aryl group including a substituted aryl group, e.g. phenyl, m-tolyl and p-tolyl, $R^2$ represents hydrogen, a lower ($C_1$–$C_3$) alkyl group e.g. methyl, or an acyl group e.g. acetyl, each of $R^3$, $R^4$, $R^5$ and $R^6$ (which may be the same or different) represents hydrogen, an alkyl group preferably a $C_1$–$C_5$ alkyl group including a substituted alkyl group, or an aryl group including a substituted aryl group.

1-Aryl-3-pyrazolidinone compounds within the scope of the above formula and suitable for use according to the present invention are known e.g. from the GB-P No. 1,093,177 filed Dec. 16, 1964 by Gevaert Photoproducten N.V. Examples are:

1-phenyl-3-pyrazolidinone also known as PHENIDONE (trade name)
1-(m-tolyl)-3-pyrazolidinone
1-phenyl-4-methyl-3-pyrazolidinone
1-phenyl-5methyl-3-pyrazolidinone
1-phenyl-4,4-dimethyl-3-pyrazolidinone
1,5-diphenyl-3-pyrazolidinone
1-(m-tolyl)-5-phenyl-3-pyrazolidinone
1-(p-tolyl)-5-phenyl-3-pyrazolidinone
and mixtures thereof.

The hydrophilic colloid binder for the silver halide emulsion layer(s) is preferably gelatin. However, the gelatin may be partly replaced by other natural and/or synthetic hydrophilic colloids, e.g. albumin, casein or zein, polyvinyl alcohol, alginic acids, cellulose derivatives such as carboxymethylcellulose and modified gelatin.

The ratio by weight of hydrophilic colloid binder to silver halide, expressed as an equivalent amount of silver nitrate, in the silver halide emulsion layer(s) of the photographic material according to the present invention is preferably 1.2 to 2.5.

In addition to said binder and silver halide and optionally developing agents, the light-sensitive element may contain in the light-sensitive emulsion layer(s) and/or in one or more layers in water-permeable relationship with the silver halide emulsion layer(s) any of the kinds of compounds customarily used in such layers for carrying out the silver complex diffusion transfer process. For example such layers may incorporate one or more coating aids, stabilizing agents or antifogging agents as described e.g. in GB-P No. 1,007,020 filed Mar. 6, 1963 by Agfa A. G., plasticizers, spectral sensitizing agents, development-modifying agents e.g. polyoxyalkylene compounds, onium compounds, and sulphur compounds of the class which have sulphur covalently bound derived from an ion such as a mercaptide or xanthate or coordinately bound sulphur from a thioether. Preferably thioethers acting as silver chelating agents with at least two sulphur atoms as donors are used. A survey of thioether compounds suitable for incorporation in silver halide emulsion layers of widely varying silver halide composition has been given in the published European patent application No. 0 026 520. Still other suitable thioether compounds serving in the production of photographic prints by the DTR-process are described in the U.S. Pat. Nos. 2,938,792; 3,021,215; 3,038,805; 3,046,134; 4,013,471; 4,072,523, 4,072,526 and in German Patent (DE-P) No. 1,124,354.

The silver halide emulsion for use in the silver complex diffusion transfer process for continuous tone reproduction is usually spectrally sensitized, e.g. it may be sensitized to blue and/or green and/or red light. Panchromatic sensitivity is required to ensure the reproduction of all colours of the visible part of the spectrum.

The support for the light-sensitive silver halide emulsion layer(s) may be any opaque or transparent support customarily employed in the art.

The support may be coated with any type of known anti-halation layer. In an anti-halation layer a suitable dye or pigment absorbs the light whereto the photographic material is exposed. For example, in panchromatically spectrally sensitized silver halide emulsion materials carbon black is used generally. In blue-sensitive, e.g. sensitive up to 530 nm light, silver halide emulsion materials (that can be treated under yellow light-darkroom conditions) the anti-halation substance may be a yellow dye or pigment. The anti-halation layer may be combined with a light-reflecting layer to improve the light-sensitivity of the photographic material as described, e.g. in U.S. Pat. No. 4,144,064.

Transparent supports are made of e.g. cellulose acetate, polyvinyl acetal, polystyrene or polyethylene terephthalate that are provided with a suitable subbing layer(s) known in the art.

Opaque paper supports are usually made of paper either or not coated with a water-impermeable layer, e.g. of a polyolefine such as polyethylene. A suitable anti-halation layer composition for use in a photographic material according to the present invention is described e.g. in U.S. Pat. No. 4,224,402.

The emulsion-coated side of the light-sensitive material for DTR-processing may be provided with a top layer that is usually free from gelatin and contains water-permeable colloids. The top layer is of such nature that the diffusion is not inhibited or restrained and that it acts, e.g., as an antistress layer also called protective layer. Appropriate water-permeable binding agents for the layer coated on top of the light-sensitive silver halide emulsion layer are e.g. methylcellulose, the sodium salt of carboxymethylcellulose, hydroxyethylcellulose, hydroxyethyl starch, hydroxypropyl starch, sodium alginate, gum tragacanth, starch, polyvinyl alcohol, polyacrylic acid, polyacrylamide, polyvinylpyrrolidone, polyoxyethylene, copoly(methyl vinyl ether/- maleic acid), etc. The thickness of this layer may vary according to the nature of the colloid used. Such layer, if present, may be transferred at least partially to the image-receiving layer when the diffusion process comes to an end.

The DTR-image may be formed in a single-support-material, also called "mono-sheet" material, containing the silver halide emulson layer(s) and image-receiving layer in water-permeable relationship, e.g. on top of each other, or may be formed on a separately supported image-receiving layer.

Examples of "mono-sheet" materials including a light-shielding pigment layer are given in the German patent specification No. 1,772,603 and the U.S. Pat. Nos. 3,629,054 and 3,928,037.

An image-receiving material suitable for use in combination with the photographic material according to the present invention may comprise an opaque or transparent support which includes supports of the kind described herebefore for the silver halide emulsion layer(s).

The image-receiving layer or a layer adjacent thereto may contain one or more agents for promoting the reduction to metallic silver of the complexed silver salt, these agents being called development nuclei. Such development nuclei have been described in the above-cited publication by A. Rott and E. Weyde in Photographic Silver Halide Diffusion Processes—Focal press, London (1972) p. 54–57. Preferably nickel sulphide nuclei are used. Development nuclei can also be incorporated into the processing liquid as is described in the GB-P No. 1,001,558, filed Apr. 13, 1962 by Gevaert Photo-Producten N.V.

In one or more layers of the image-receiving material substances may be incorporated which play a prominent role in the formation of diffusion transfer images. Such substances include black-toning agents, e.g. those described in the GB-P No. 561,875, filed Dec. 3, 1942 by Ilford Ltd. and in the BE-P No. 502,525 filed Apr. 12, 1951 by Agfa A. G. A preferred black-toning agent is 1-phenyl-5-mercapto-tetrazole.

The image-receiving layer may also comprise a silver halide solvent, e.g. sodium thiosulphate in an amount of about 0.1 to about 4 g per sq.m.

The image-receiving material may also contain in the layer containing development nuclei hardening agents, plasticizing agents, optical brightening agents and substances improving the adherence of said layer to its support.

A suitable hardening agent is a triazine compound having the following structural formula:

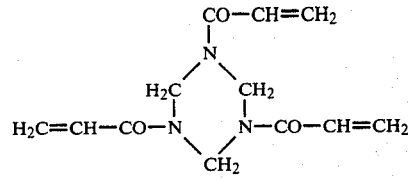

Other suitable hardening agents are bisvinylsulphonyl hardeners as described e.g. in DE-OS No. 2 749 260 and in DE-P No. 1 808 685, DE-OS No. 2 348 194 and Research Disclosure 22 507 of January 1983, e.g. divinylsulphones of the formula $(CH_2{=}CH{-}SO_2)_2{-}R$, wherein R is $-CH_2-CH_2-O-CH_2-CH_2-$, $-(CH_2)_n-$ with n is 1 to 6 or $CH_3O(CH_2)_2-CH{=}$.

A suitable plasticizing binding agent includes repeating units x, y and z as represented in the following general formula:

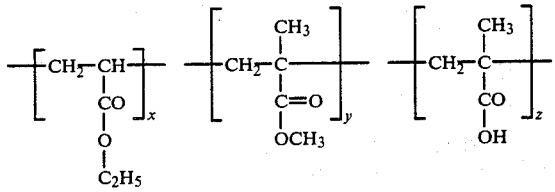

A suitable optical brightening agent has the following structural formula:

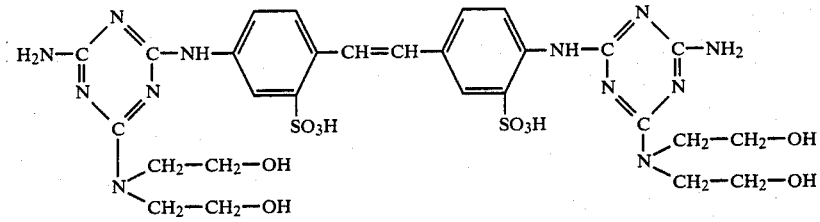

In order to obtain an increase in maximum density and to improve the image tone by shifting it to more neutral black the image-receiving material may contain in operative contact with the developing nuclei the sulphur compounds, preferably the thioether compounds already mentioned in connection with the light-sensitive silver halide emulsion layer(s).

Particularly useful thioether compounds for application in the image-receiving material are described in German Patent (DE-P) No. 1,124,354, in the U.S. Pat. Nos. 4,013,471; 4,072,526 and in published European patent application No. 0 026 520.

The image-receiving layer may consist of or comprise any of the binding agents mentioned hereinbefore for the silver halide. Gelatin is the preferred binding agent for the image-receiving layer.

The adherence to resin film supports or paper supports of layers containing colloidal silica ($SiO_2$) may be improved with epoxysilane compounds, e.g. a compound having the following structural formula:

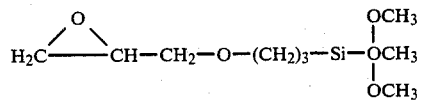

The image-receiving material may be provided with printing matter, e.g. with any type of recognition data applied by any type of conventional printing process such as offset printing, intaglio printing, etc.

The processing liquid used in processing a photographic material according to the present invention usually contains alkaline substances such as tribasic phosphate, preserving agents e.g. sodium sulphite, thickening agents e.g. hydroxyethylcellulose and carboxymethylcellulose, fog-inhibiting agents such as potassium bromide, silver halide solvents e.g. ammonium or sodium thiosulphate, black-toning agents especially heterocyclic mercapto compounds e.g. 1-phenyl-5-mercaptotetrazole. The pH of the processing liquid is preferably in the range of 10 to 14.

When using a water-soluble thiosulphate as silver halide solvent an amount in the range of 10 g/l to 30 g/l in the processing liquid yields good results.

For particulars about exposure and developing apparatus, which may be applied in the DTR-process according to the present invention reference is made e.g. to "Photographic Silver Halide Diffusion Processes" by A. Rott and E. Weyde, Focal Press London, New York 1972 and to patent literature cited therein.

The light-sensitive material of the present invention finds an advantageous use in photographic cameras wherein continuous tone information has to be recorded, for example in portraiture, in the recording of fluorescent screen images and especially in cathode-ray tube photography. The excellent continuous tone reproduction, however, does not exclude the material from recording thereon documents and all kinds of graphic art data so that the material is particularly suited at the same time for portraiture work and recording graphic data relating to the portrayed person. Such data are present e.g. on documents of the kind of drivers licences, bank cheques, identity cards, security documents, etc. The negative, if desired, may be used as a file copy and for making further prints.

A photographic camera suitable for portraiture and graphic data recording and wherein a photographic silver halide material and a receiving material for the DTR-process are used is described, e.g., in U.S. Pat. No. 4,011,570 by Emile Frans Stiévenart and Hugo Frans Deconinck, issued Mar. 8, 1977.

The photographic materials of the present invention may be used as a roll film, sheet film or filmpack type photosensitive material, e.g., for in-camera-processing.

In order to obtain a better image stability, e.g. on storage under daylight conditions, the DTR-processed photographic material may be subjected to a further fixing treatment, e.g. an aqueous thiosulphate treatment followed by a rinsing step. A suitable apparatus for carrying out these steps is the two-bath RAPIDOPRINT (trade mark of Agfa-Gevaert N. V.) apparatus used in stabilization processing.

The following examples illustrate the present invention.

The ratios and percentages are by weight unless otherwise stated.

EXAMPLE 1 (COMPARATIVE EXAMPLE)

Preparation of a photographic material P

A. Preparation of the silver halide emulsion P

A gelatino silver halide emulsion P was prepared by single jet procedure by slowly adding with stirring an aqueous solution having a concentration of 2.94 mole of silver nitrate per liter to a gelatin solution containing 10 g of gelatin per liter and 3.85 mole of sodium chloride, 0.22 mole of potassium bromide and 0.03 mole of potassium iodide.

The temperature during the silver halide formation was 50° C.

The subsequent ripening process was carried out at 55° C. with thiosulphate and gold salts known to those skilled in the art.

The emulsion was cooled, precipitated and washed and gelatin was added thereto in an amount sufficient to reach a ratio by weight of gelatin to silver halide, expressed as equivalent amount of silver nitrate, of 1.5. The average grain size of the silver halide grains was 0.15 μm.

The silver halide emulsion was coated onto an anti-halation layer, the composition of which is given hereinafter, at a coverage of 1.5 g of silver halide expressed as silver nitrate per $m^2$.

Composition of the Anti-Halation Layer

The anti-halation layer contained per $m^2$ 3 g of gelatin, 0.6 g of catechol, 0.3 g of 1-phenyl-4,4-dimethyl-3-pyrazolidinone and a sufficient amount of lamp black to obtain in that layer an optical density of 2.0. Said anti-halation layer was coated onto a transparent subbed polyethylene terephthalate support.

Preparation of a Photographic Material Q

B. Preparation of the silver halide emulsion Q

A gelatino silver halide emulsion Q was prepared by double jet procedure by slowly adding with stirring an aqueous solution having a concentration of 2.94 mole of silver nitrate per liter to a gelatin solution containing 10 g of gelatin per liter and 2.94 mole of sodium bromide, and 0.03 mole of potassium iodide.

The temperature during the silver halide formation was 50° C.

The subsequent ripening process was carried out at 58° C. with thiosulphate and gold salts known to those skilled in the art.

The emulsion was cooled, precipitated and washed and gelatin was added thereto in an amount sufficient to reach a ratio by weight of gelatin to silver halide, expressed as equivalent amount of silver nitrate, of 1.5. The average grain size of the silver halide grains was 0.2 μm.

The silver halide emulsion Q was coated onto the same anti-halation layer as described for material P.

Figure 2:
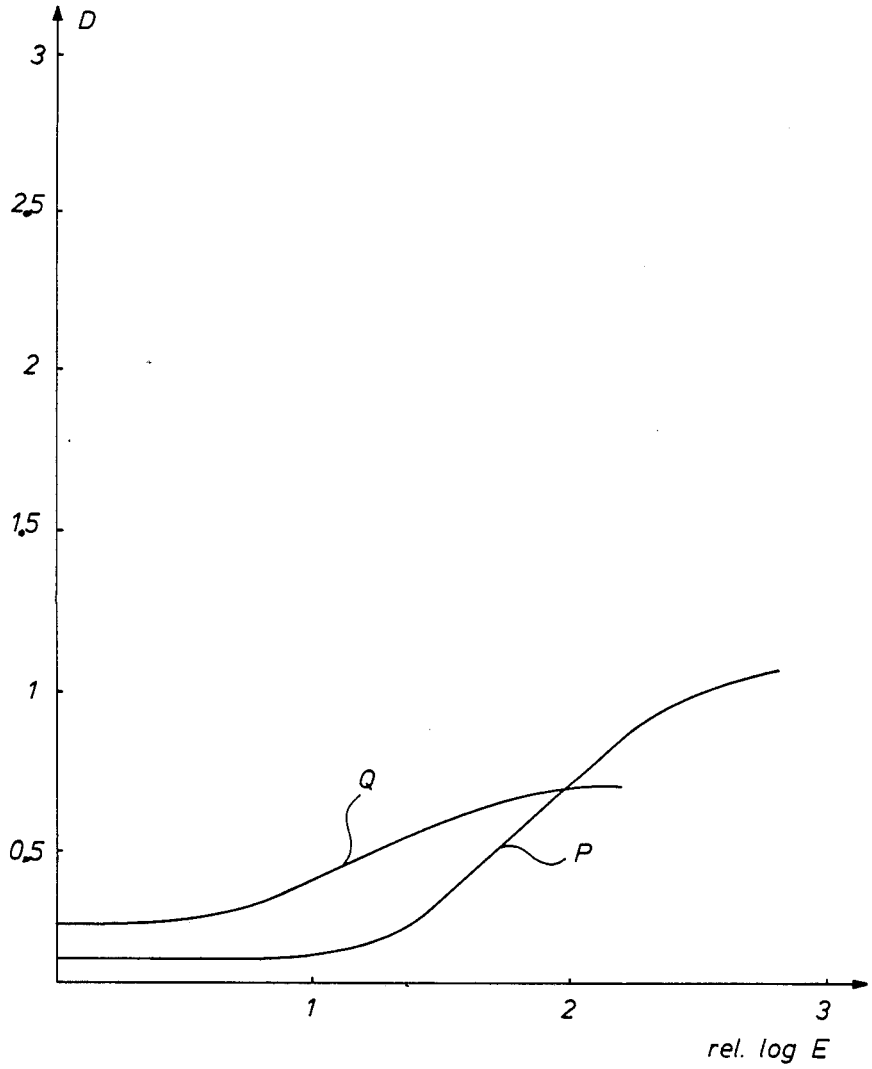
FIG. 2 represents sensitometric curves of negative images obtained in the photographic materials P and Q by the development defined in above point (3).

The silver halide emulsions P and Q comply with the requirements set forth in the already mentioned points (2) and (3) and to prove their difference in sensitivity they were coated and processed in the conditions described in point (3). The sensitometric curves obtained with these materials are given in the accompanying FIG. 2 (Δ log E at density 0.3 is 0.8).

Preparation of Photographic Material I According to the Present Invention

C. Preparation of the mixed silver halide emulsion I

The silver halide emulsions P and Q were mixed in such a ratio that 94 mole % of the silver halide was derived from silver halide emulsion P and 6 mole % was derived from silver halide emulsion Q.

The coating of emulsion I proceeded as described for the materials P and Q.

D. Image-receiving material

The image-receiving material contained a paper support of 110 g/sq.m coated at both sides with polyethylene at a ratio of 15 g/sq.m per side. This support was treated with a corona discharge whereupon a layer was coated at a ratio of 18.1 sq.m/l from the following composition:

| | |
|---|---|
| carboxymethyl cellulose | 12 g |
| gelatin | 45 g |
| nickel sulphide nuclei (an aqueous suspension of 2% by weight of gelatin and 0.6% by weight of NiS) | 7 ml |
| water to make | 1000 ml |

E. Exposure and diffusion transfer reversal processing

The photographic materials P, Q and I were exposed in a reflex camera to a step wedge with a constant 0.15 serving as continuous tone original.

After the exposure the silver halide emulsion layers P, Q and I were each brought 30 s into contact with separate sheets of the above described image-receiving material in a commercial DTR-processing apparatus containing a processing liquid kept at 25° C. and having the following composition:

| | |
|---|---|
| water | 800 ml |
| tribasic sodium phosphate-12-water | 75 g |
| anhydrous sodium sulphite | 40 g |
| potassium bromide | 0.5 g |
| anhydrous sodium thiosulphate | 20 g |
| 1-phenyl-5-mercaptotetrazole | 70 mg |
| water to make | 1000 ml |

After separation the photographic materials were treated with a 52% aqueous ammonium thiosulphate solution, rinsed with water and dried.

The sensitometric curves (density D versus relative log exposure, abbreviated rel. log E) obtained in the receiving materials (diffuse reflection densities as defined have been measured) with the photographic materials P, Q and I respectively are given in the accompanying FIG. 1. By comparing curves P, Q and I obtained with said materials P, Q and I respectively the conclusion may be drawn that photographic material P does not yield a DTR-image of sufficiently low average gradient for reproducing a continuous tone original in a sufficiently correct tone scale and the photographic material Q does not yield a continuous tone image of sufficient optical density, whereas the shape of the sensitometric curve I of the DTR-image obtained with photographic material I according to the present invention ensures a correct continuous tone reproduction of most of the available continuous tone originals.

EXAMPLE 2

Figure 3:
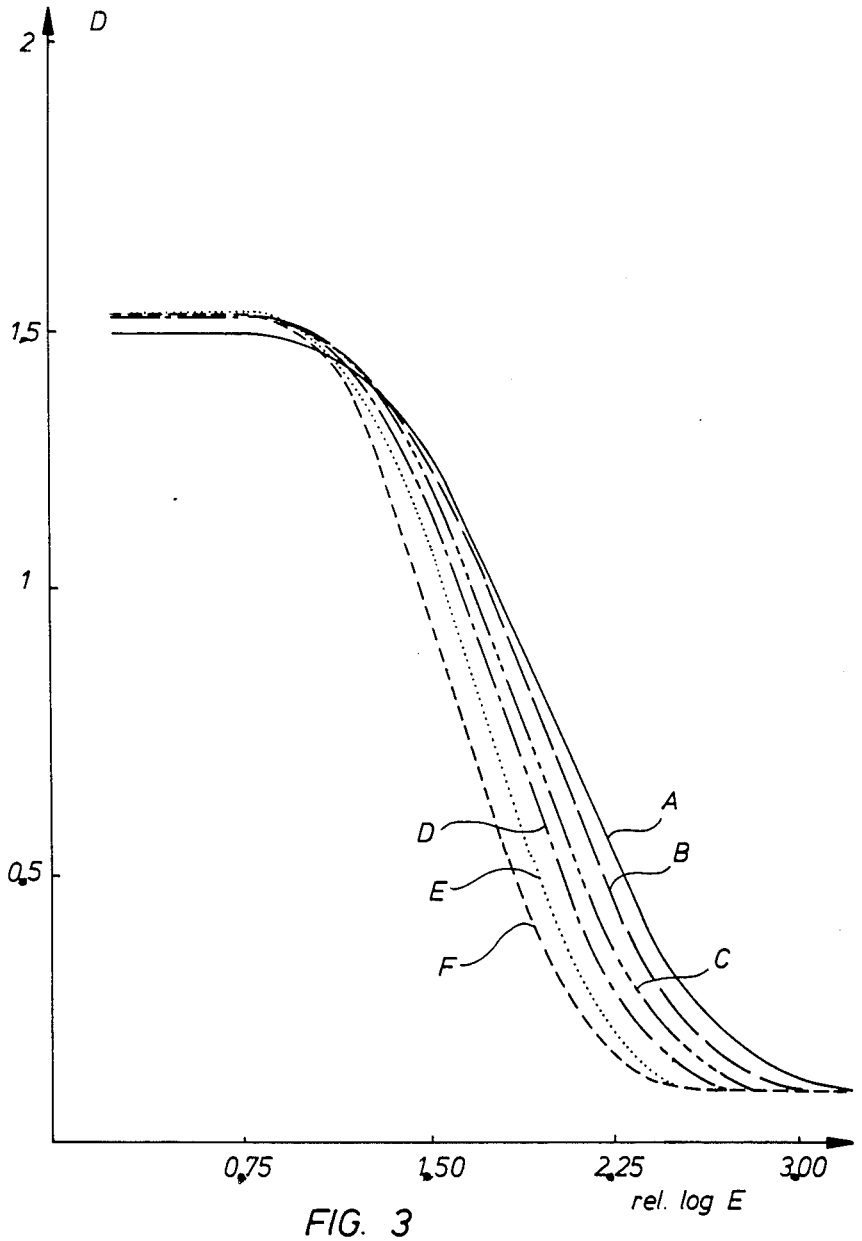
FIG. 3 illustrates the dependency on the processing temperature of the maximum gradient of a DTR-image obtained according to the present invention.

The influence of different processing temperatures on the maximum gradient and shape of the sensitometric curve of a DTR-image obtained with material I according to Example I (diffuse reflection densities are measured as defined), is given in the accompanying FIG. 3. The graphs A, B, C, D, E and F correspond with the temperatures 16°, 18°, 20°, 22°, 24° and 26° C. respectively.

EXAMPLE 3

Figure 4:
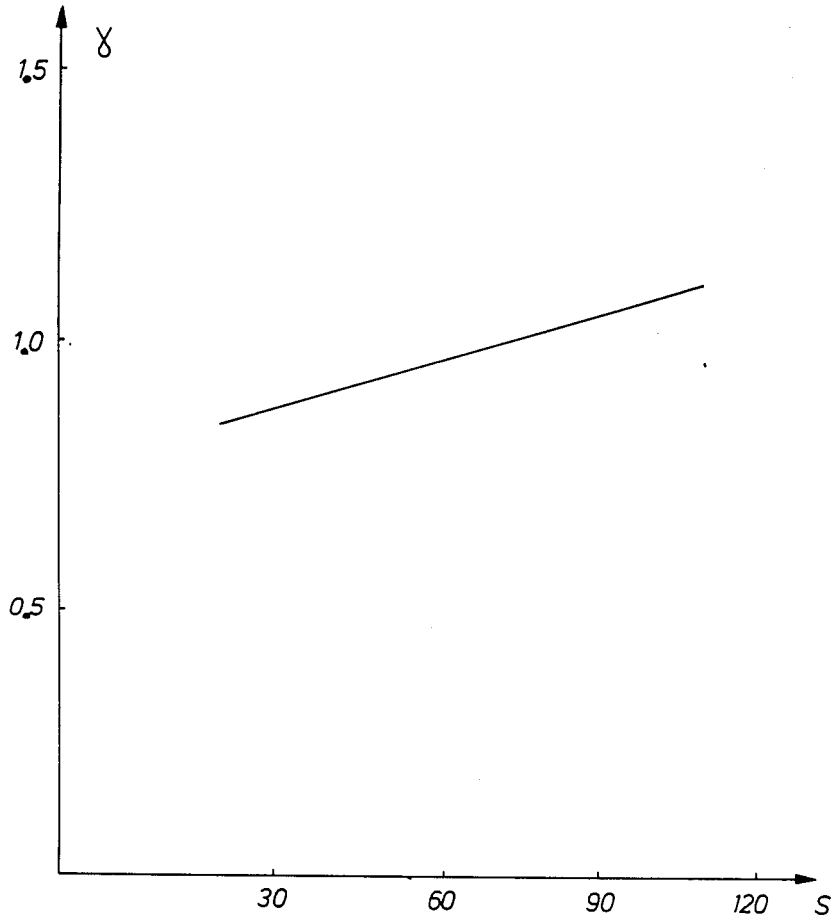
FIG. 4 illustrates the dependency on the transfer-contact-time of the maximum gradient of a DTR-image obtained according to the present invention.

The influence of different diffusion-transfer contact times in seconds (s) on the maximum gradient ($\gamma$) of a DTR-image obtained with material I according to Example 1 on an image-receiving layer applied on an opaque paper support (diffuse reflection densities as defined have been measured) is illustrated in the accompanying FIG. 4.

EXAMPLE 4

Photographic materials were prepared as described in Example 1 but containing emulsions P4 and different emulsions Q41, Q42 and Q43 respectively in 90/10 and 95/5 molar percentages.

Emulsion P4 contained 93.59 mole % of silver chloride, 5.83 mole % of silver bromide and 0.58 mole % of silver iodide. Its average grain size was 0.148 μm.

Emulsion Q41 contained 78.16 mole % of silver chloride, 21.22 mole % of silver bromide and 0.61 mole % of silver iodide.

Emulsion Q42 contained 86.73 mole % of silver chloride, 12.66 mole % of silver bromide and 0.59 mole % of silver iodide.

Emulsion Q43 contained 94.02 mole % of silver chloride, 5.39 mole % of silver bromide and 0.57 mole % of silver iodide.

Average grain size of these Q41, Q42 and Q43 emulsions was 0.288 μm.

These silver halide emulsions P4, Q41, Q42 and Q43 comply with the requirements set forth in the already mentioned points (2) and (3), the more sensitive emulsions Q41, Q42 and Q43 emulsions yield photographic materials having at density 0.3 a $\Delta$ log E value of 0.8 with respect to the log E value of the photographic material prepared with emulsion P4.

In the following Table 1 the results obtained by exposure in diffusion transfer reversal processing as described in Example 1 are given.

Said Table 1, contains maximum density (Dmax) above fog 0.1, maximum gradient ($\gamma$) and copying latitude (L), defined as the difference in relative log exposure corresponding with the straight line portion of the sensitometric curve of the DTR-images obtained with the photographic materials containing the mixed P4 and Q41, Q42 and Q43 emulsions in the ratio indicated and mentioning the molar silver bromide content of the more sensitive Q-emulsions.

TABLE 1

| mole % AgX P | mole % AgX Q | mole % AgBr in Q | Dmax | $\gamma$ | L |
|---|---|---|---|---|---|
| 100 | — | — | 1.51 | 1.98 | 0.94 |
| 90 | 10 | 21.22 | 1.34 | 0.99 | 1.40 |
| 90 | 10 | 12.66 | 1.62 | 0.97 | 1.42 |
| 90 | 10 | 5.39 | 1.56 | 1.06 | 1.56 |
| 95 | 5 | 21.22 | 1.32 | 1.39 | 1.28 |
| 95 | 5 | 12.66 | 1.35 | 1.37 | 1.34 |
| 95 | 5 | 5.39 | 1.31 | 1.62 | 1.28 |
| 85 | 15 | 21.22 | 1.45 | X | |

The $\gamma$ corresponding with the value X is not the same in the toe as in the shoulder, viz. 2.0 and 0.7 respectively.

EXAMPLE 5

A. The preparation of the silver halide emulsion P proceeded as described in Example 1.

B. Preparation of silver halide emulsion Q5.

A gelatino silver halide emulsion Q5 was prepared by single jet procedure by slowly adding with stirring an aqueous solution having a concentration of 1 mole of silver nitrate per liter to a gelatin solution containing 10 g of gelatin per liter, 1.10 mole of potassium bromide and 0.03 mole of potassium iodide.

The temperature during the silver halide formation was 50° C.

The subsequent ripening process was carried out at 58° C. with thiosulphate and gold salts known to those skilled in the art.

The emulsion was cooled, precipitated and washed and gelatin was added thereto in an amount sufficient to reach a ratio by weight of gelatin to silver halide, expressed as equivalent amount of silver nitrate, of 1.5.

The sensitivity difference (Δ log E) between separately coated emulsion layers P and Q5 was 0.70 log E defined according to the test conditions of the already mentioned point (3).

For the preparation of photographic materials according to the present invention as described in Example 1, the emulsions P and Q5 were used in admixture in a % molar ratio of their silver halide as defined in the following Table 2. In the same Table also the maximum gradient, (γ-value measured between optical density 0.25 above fog and optical density 1.75 above fog) and the maximum optical density ($D_{max}$) obtained according to the DTR-processing conditions described in Example 1, with the difference that the support of the image-receiving material was a transparent polyethylene terephthalate support, are given (diffuse transmission densities measured as defined have been given). For comparison purposes a material with solely emulsion P (100% AgX P) was tested.

TABLE 2

| mole % AgX P | mole % AgX Q5 | γ | Dmax | L |
|---|---|---|---|---|
| 100 | — | 5.3 | 3.2 | 0.85 |
| 98 | 2 | 3.5 | 3.2 | 1.00 |
| 96 | 4 | 2.6 | 3.2 | 1.15 |
| 92 | 8 | 2.3 | 3.2 | 1.20 |
| 88 | 12 | 1.8 | 3.2 | 1.35 |
| 80 | 20 | X | | |

The corresponding with the value X is markedly different in the toe and in the shoulder.

EXAMPLE 6

Example 5 was repeated with the difference, however that the emulsion Q5 was replaced by emulsion Q6 that has been prepared by adding 1 mole of silver nitrate to 1 mole of potassium bromide and 0.1 of potassium iodide.

The sensitivity difference (Δ log E) between separately coated emulsion layers P and Q6 was 0.80 log E according to the test conditions of above point (3).

The photographic material according to the present invention prepared by mixing emulsions P and Q6 in a molar silver halide ratio of 90 to 10 yielded under the processing conditions of Example 5 a γ-value of 1.70, L value of 1.40 and a $D_{max}$ of 3.20.

EXAMPLE 7

Example 5 was repeated with the difference, however that the emulsion Q5 was replaced by emulsion Q7 that was prepared by adding 1 mole of silver nitrate to 1.10 mole of sodium chloride, 0.8 mole of potassium bromide and 0.02 mole of potassium iodide and that emulsion P was replaced by emulsion P7 that was prepared by adding 1 mole of silver nitrate to 1.10 mole of sodium chloride, 0.25 mole of potassium bromide and 0.02 mole of sodium iodide.

The sensitivity difference (Δ log E) between separately coated emulsion layers P7 and Q7 was 0.40 log E according to the test conditions of said point (3).

Figure 5:
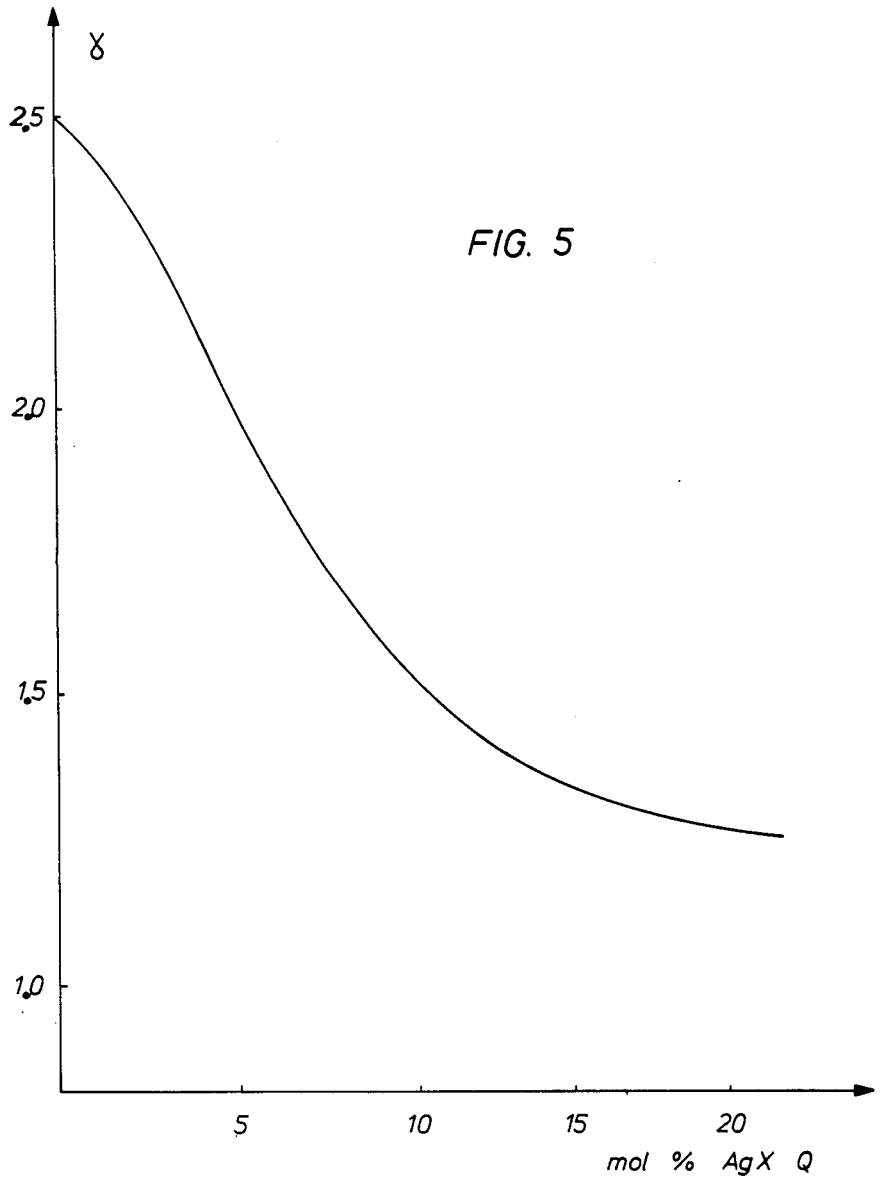
FIG. 5 illustrates the dependency of maximum gradient on the molar ratio of a particular emulsion P with respect to a particular emulsion Q in DTR-processing.

The accompanying FIG. 5 gives a survey of the influence on maximum gradient of different mixtures of emulsions P7 and Q7 in DTR-processing according to Example 1.

We claim:

1. In a method for the production of continuous tone silver images by diffusion transfer reversal processing, wherein a photographic material is image-wise exposed to continuous tone information and subjected to a diffusion-transfer-reversal processing under alkaline aqueous conditions in the presence of at least one developing agent and a silver ion complexing agent to transfer complexed silver ions to a separate receiving layer and containing development nuclei catalyzing the reduction of transferred complexed silver ions, the improvement comprising:

(1) said photographic material contains two independently prepared hydrophilic colloid-silver halide emulsions of different halide composition and different photo-sensitivity in operative contact on the same side of the same support;

(2) the first of said silver halide emulsions is a silver halide emulsion containing at least 70 mole % of silver chloride and from 0 to 5 mole % of silver iodice, with the remainder being silver bromide, and the second silver halide emulsion is a silver bromide emulsion free from AgCl or is a silver bromochloride emulsion having a silver chloride content not exceeding that of said first emulsion by more than 2 mole %, said second emulsion containing from 0 to 10 mole % of AgI;

(3) the second silver halide emulsion has a sufficiently higher sensitivity to 400–700 nm light than the first silver halide emulsion that under the same wedge exposure conditions and development conditions as specified hereinafter, the log exposure values (log E) of a first emulsion layer alone on a transparent support and of a second emulsion layer only on such support at the same silver halide coverage of $3.5\times10^{-2}$ moles of silver halide per $m^2$ and a ratio by weight of gelatin binder to silver halide expressed as equivalent grams of silver nitrate of 0.5, with said log exposures being measured at density 0.3, differ from each other by a value of at least 0.30 and at most 1.50, and (4) the molar proportion in said photographic material of silver halide grains of said first emulsion to silver halide grains of said second emulsion is such that the maximum gradient, or gamma (γ), of the sensitometric curve of a wedge image obtained by said diffusion-transfer-reversal process with said photographic material in an image-receiving layer carried on an opaque support having a diffuse reflection density of 0.08 is not higher than 1.50, or (5) the molar proportion in said photographic material of silver halide grains of said first emulsion to silver halide grains of said second emulsion is such that the maximum gradient, or gamma (γ), of the sensitometric curve of a wedge image obtained by said diffusion-transfer-reversal process with said photographic material in an image-receiving layer carried on a transparent support having a diffuse transmission density of 0.08 is not higher than 3.00; and said development conditions called for in (3) above being the following:

| developer composition | |
|---|---|
| demineralized water | 800 ml |

-continued

| | |
|---|---|
| p-methylamino-phenol | 1.5 g |
| sodium sulphite | 50 g |
| hydroquinone | 6 g |
| sodium carbonate | 32 g |
| potassium bromide | 2 g |
| ethylene diamine tetra-acetic acid sodium salt | 1.5 g |
| demineralized water up to | 1000 ml |
| development temperature | 20° C. |
| development duration | 3 min. |

2. A method for the production of continuous toner silver images according to claim 1, wherein the maximum gradient according to (4) above is in the range of 1.50 and 0.9 corresponding with a range of exposure latitudes (L) of 1.0 to 1.6.

3. A method for the production of continuous tone silver images according to claim 1, wherein the maximum gradient according to (5) above is in the range of 3.00 to 1.70 corresponding with a range of exposure latitudes (L) of 1.00 to 1.40.

4. A method for the production of continuous tone silver images according to claim 1, wherein said first emulsion contains silver halide grans having a mean grain size in the range of 0.05 to 0.50 μm and said second emulsion contains silver halide grains having a mean grain size in the range of 0.1 to 1.00 μm.

5. A method for the production of continuous tone silver images according to claim 1, wherein the relative silver halide coverage of said first emulsion to said second emulsion is in the molar range of 88/12 to 96/4.

6. A method for the production of continuous tone silver images according to claim 1, wherein the photographic material contains a mixture of developing agents including a o-dihydroxybenzene and a 3-pyrazolidinone development agent.

7. In a photographic material adapted for the production of continuous tone silver images by image-wise exposure to continuous tone information and diffusion-transfer-reversal processing under alkaline aqueous conditions in the presence of at least one developing agent and a silver ion complexing agent for transferring complexed silver ions to a separate receiving layer containing development nuclei catalyzing the reduction of transferred complexed silver ions, the improvement comprising:

(1) said photographic material contains two independently prepared hydrophilic colloid-silver halide emulsions of different halide composition and different photo-sensitivity in operative contact on the same side of the same support;

(2) one of said silver halide emulsions is a silver halide emulsion containing at least 70 mole % of silver chloride and from 0 to 5 mole % of silver iodide, the remainder being silver bromide, and the second silver halide emulsion is a silver bromide emulsion free from AgCl or is a silver bromochloride emulsion having a silver chloride content not exceeding that of said first emulsion by more than 2 mole %, said second emulsion containing from 0 to 10 mole % of AgI;

(3) the second silver halide emulsion has a sufficiently higher sensitivity to 400–700 nm light than the first silver halide emulsion that under the same wedge exposure conditions and development conditions as specified hereinafter, the log exposure values (log E) of a first emulsion layer only on a transparent support and of a second emulsion layer only on such support at the same silver halide coverage of $3.5\times10^{-2}$ moles of silver halide per $m^2$ and a ratio by weight of gelatin binder to silver halide expressed as equivalent grams of silver nitrate of 0.5, with said log exposures being measured at density 0.3, differ from each other by a value of at least 0.30 and at most 1.50, and (4) the molar proportion in said photographic material of silver halide grains of said first emulsion to silver halide grains of said second emulsion is such that the maximum gradient, or gamma (γ), of the sensitometric curve of a wedge image obtained by said diffusion-transfer-reversal process with said photographic material in an image-receiving layer carried on an opaque support having a diffuse reflection density of 0.08 is not higher than 1.50, or (5) the molar proportion in said photographic material of silver halide grains of said first emulsion to silver halide grains of said second emulsion is such that the maximum gradient, or gamma (γ), of the sensitometric curve of a wedge image obtained by said diffusion-transfer-reversal process with said photographic material in an image-receiving layer carried on a transparent support having a diffuse transmission density of 0.08 is not higher than 3.00;

said development conditions called for in (3) above being the following:

| developer composition | |
|---|---|
| demineralized water | 800 ml |
| p-methylamino-phenol | 1.5 g |
| sodium sulphite | 50 g |
| hydroquinone | 6 g |
| sodium carbonate | 32 g |
| potassium bromide | 2 g |
| ethylene diamine tetra-acetic acid sodium salt | 1.5 g |
| demineralized water up to | 1000 ml |
| development temperature | 20° C. |
| development duration | 3 min. |

8. A photographic material for the production of continuous tone silver images according to claim 7, wherein the maximum gradient according to (4) above is in the range of 1.50 and 0.9 corresponding with a range of exposure latitudes (1) of 1.0 to 1.6.

9. A photographic material for the production of continuous tone silver images according to claim 7, wherein the maximum gradient according to (5) above is in the range of 3.00 to 1.70 corresponding with a range of exposure latitudes (L) of 1.00 to 1.40.

10. A photographic material for the production of continuous tone silver images according to claim 7, wherein said first emulsion contains silver halide grains having a mean grain size in the range of 0.05 to 0.50 μm and said second emulsion contains silver halide grains having a mean grain size in the range of 0.1 to 1.00 μm.

11. A photographic material for the production of continuous tone silver images according to claim 7, wherein the relative silver halide coverage of said first emulsion to said second emulsion is in the molar range of 88/12 to 96/4.

12. A photographic material for the production of continuous tone silver images according to claim 7, wherein the ratio by weight of hydrophilic colloid binder to silver halide, expressed as an equivalent amount of silver nitrate, in such silver halide emulsion layer of the photographic material is 1.2 to 2.5.

* * * * *